US006434749B1

(12) United States Patent
Grounds et al.

(10) Patent No.: US 6,434,749 B1
(45) Date of Patent: Aug. 20, 2002

(54) SELECTIVELY PADDED WETSUIT GARMENT

(75) Inventors: Brighdie M. Grounds; Jonathan Paskowitz, both of Costa Mesa; Amber Sakai, Beverly Hills, all of CA (US)

(73) Assignee: Four Girls, LLC, Costa Mesa, CA (US)

( * ) Notice: Subject to any disclaimer, the term of this patent is extended or adjusted under 35 U.S.C. 154(b) by 0 days.

(21) Appl. No.: 09/682,472

(22) Filed: Sep. 6, 2001

Related U.S. Application Data

(60) Provisional application No. 60/230,737, filed on Sep. 7, 2000.

(51) Int. Cl.[7] ..... B63C 11/04; B63C 11/10

(52) U.S. Cl. ..... 2/2.15; 2/2.15; 2/2.17; 2/456

(58) Field of Search ..... 2/455, 456, 459, 2/460, 461, 465, 467, 466, 267, 216, 2.15, 2.17

(56) References Cited

U.S. PATENT DOCUMENTS 4,441,211 A * 4/1984 Donzis ..... 2/459
4,577,346 A * 3/1986 Hall ..... 2/464
4,866,789 A * 9/1989 Dorm ..... 2/462
5,465,424 A * 11/1995 Cudney et al. ..... 2/102
5,500,952 A * 3/1996 Keyes ..... 2/465
5,636,377 A * 6/1997 Wiener ..... 2/2.5
5,836,015 A * 11/1998 Kristensen et al. ..... 2/228
5,918,310 A * 7/1999 Farahany ..... 2/228
5,926,856 A * 7/1999 Duval ..... 2/22

* cited by examiner

*Primary Examiner*—Amy B. Vanatta
*Assistant Examiner*—Robert H. Muromoto, Jr.
(74) *Attorney, Agent, or Firm*—Sheldon & Mak, PC; Robert J. Rose

(57) ABSTRACT

A garment for use in watersports to protect one or more than one vulnerable region of a person's body considered susceptible to injury associated with repetitive contact with a hard surfboard surface, comprising a body garment (10) having an inside surface and an outer surface; and one or more than one cushioning pad (12, 14, 16, 18, 20) connected to the body garment (10), disposed adjacent the inside surface, or the outer surface, or the inside surface and the outer surface, and positioned in juxtaposition to the one or more than one vulnerable region of the body, and one or more than one insert pad (44) for insertion into one or more than one pocket (26). The vulnerable regions may be optionally selected from the group consisting of the body area in proximity to the ribs, upper hips, elbows, inner elbows, knees, ankles, front of ankles adjacent the feet, and lower back.

27 Claims, 7 Drawing Sheets

SELECTIVELY PADDED WETSUIT GARMENT

CROSS REFERENCE TO RELATED APPLICATIONS

The present Application claims the benefit of United States Provisional Patent Application 60/230,737 titled "Selectively Padded Watersports Attire," filed Sep. 7, 2000; the contents of which are incorporated by reference in this disclosure in their entirety.

BACKGROUND OF THE INVENTION

The present invention relates to watersports attire and relates more particularly to a surfing wetsuit garment having padding in selected areas.

Hardboard surfing is enjoying increasing popularity as more and more people learn to ride the waves. Although the sport of surfing has been dominated by men for many years, the tide is changing and women are paddling into the surf zone in increasing numbers to surf along side the men.

Surfboards are typically constructed of a lightweight foam coated with a hard fiberglass shell. While surfers typically apply a wax coating to the upper surface of the fiberglass shell in order to provide traction, the board is generally used with no matter other than clothing between the board and the surfer.

Much of the surfer's time is spent paddling the board in order to attain proper positioning for catching and riding waves. To paddle, surfers usually lay prone on the board, often with their backs arched. Sometimes surfers will kneel on the board while paddling.

While laying prone or kneeling on the hard surfboard surface, the weight of a surfer's body if generally distributed over the body, but tends to concentrate at various pressure points. For instance, while paddling, the weight of a surfer's torso is mostly supported by the lower ribs, hips and knees. These exemplary pressure points tend to become sore from supporting the surfer's weight on the hard surfboard. This soreness is exacerbated due to the turbulent nature of the coastal waters through which surfers paddle. Factors such as wind, swell, currents and the waves the surfers intend to ride contribute to the turbulence of the coastal waters and result in a bumpy, inconsistent ride as a surfer paddles along. This bumpy ride causes the surfer's body to repeatedly, and sometimes traumatically, impact the surfboard.

Moreover, when paddling, a surfer's body is generally continuously in motion in order to maintain balance in reaction to the turbulent nature of the surrounding waters.

In particular, the surfer shifts body weight to and from the pressure points of the body to engage selected portions of the surfboard surface. This weight shifting results in repetitive movement of the pressure points relative to the hard and waxy upper surface of the surfboard, further contributing to the soreness of the pressure points and also leading to further side effects. Such continuous movement, combined with the weight of the surfer's body and the bumpy and sometimes traumatic ride through the turbulent waters can cause the pressure points to bruise and chafe.

Continued paddling with such injuries can lead to more serious injuries such as development of calluses, and even scarring. These injuries increase the surfer's discomfort while surfing, possibly decreasing the surfer's level of performance and causing the surfer to spend less time surfing.

Other parts of surfers' bodies, such as elbows and ankles, may also experience bruising and chafing due to repetitive contact and impact with the hard surfboard.

Still further, during surfing, the surfer's body often traumatically contacts the surfboard while riding waves. This is especially true if the surfer "wipes out" and is struck by or lands on the surfboard. Additionally, some surfing maneuvers dictate close interaction with and even leaping onto the surfboard.

Accordingly, there is a need for attire that will reduce or prevent bruising and chafing of specific portions of a surfer's body during surfing. Preferably the garment should be a wetsuit and other surfing attire that can be worn while surfing to pad specific areas of the body in order to avoid the aches, bruising, chafing and such that are associated with repetitive contact with the hard surfboard surface.

SUMMARY OF THE INVENTION

The invention meets this need by providing a wetsuit garment that can be worn while surfing to pad specific areas of the body in order to avoid the aches, bruising, chafing and such that are associated with repetitive contact with the hard surfboard surface. A garment for use in watersports to protect one or more than one vulnerable region of a person's body considered susceptible to injury associated with repetitive contact with a hard surfboard surface is described comprising a body garment having an inside surface and an outer surface; and one or more than one cushioning pad connected to the body garment, disposed adjacent the inside surface, or the outer surface, or the inside surface and the outer surface, and positioned in juxtaposition to the one or more than one vulnerable region of the body. In certain embodiments, the one or more than one vulnerable region may be selected from the group consisting of the body area in proximity to the ribs, upper hips, elbows, inner elbows, knees, ankles, front of ankles adjacent the feet, and lower back.

In a preferred embodiment, when the vulnerable region comprises the upper hips, the one or more than one cushioning pad comprises two hip pads each having a downwardly-angled curved shape. Additionally, optionally when the vulnerable region comprises the upper hips and the lower back, the one or more than one cushioning pad comprises a belt of padding which encircles the upper hip and lower back area.

In another embodiment the one or more than one cushioning pad is glued or sewn to the body garment. In a further embodiment, the body garment further comprises one or more than one seam, and the one or more than one cushioning pad is sewn to the body garment along a seam, Additionally, optionally the body garment may have a second layer interior of the inside surface, where the one or more than one cushioning pad is sealed between the inside surface of the body garment and the second layer.

In a preferred embodiment, the one or more than one cushioning pad connected to the body garment comprises one or more than one insert pad having a thickness and one or more than one pocket for receiving the one or more than one insert pad. In a further preferred embodiment, the insert pad has a shape generally complementary to the shape of the pocket. In another preferred embodiment, the thickness of the one or more than one insert pad is about 3 millimeters. A system of insert pads of varying thickness and stiffness is disclosed.

In a preferred embodiment the one or more than one insert pad comprises a flexible material, which may be selected from the group consisting of ethyl vinyl acetate (EVA) foam, elastomeric foam and silicone. Additionally, optionally the one or more than one insert pad comprises a sealed sac containing silicone gel, saline solution, water or air.

In a further embodiment, the garment further comprises a hook and loop fastener connected to the one or more than one insert pad and the one or more than one pocket to releasably engage the insert pad in the pocket.

In a preferred embodiment, where the vulnerable region comprises the ribs, the one or more than one pocket comprises two rib pockets. In a further embodiment, each of the two rib pockets further comprise an upper rib pocket and a lower rib pocket. In a further preferred embodiment, the body garment further comprises a main side seam, wherein each of the two rib pockets are sewn onto the main side seam of the body garment. Additionally, optionally the one or more than one pocket may be divided.

In a further embodiment, where the vulnerable region comprises the ribs, the one or more than one pocket comprises a single rib pocket.

In a preferred embodiment, the one or more than one pocket comprises a first side having a first thickness and an edge and a second side having a second thickness and an edge, the first side and second side overlapping each other and being sewn together along their respective edges such that the first side and second side are not attached along a free edge of the second side, creating an opening between the first side and second side, a leading edge of the first side extending somewhat beyond the free edge of the second side, and the pocket being connected to the body garment along the leading edge. In a further preferred embodiment, the leading edge is connected to the body garment such that the pocket is biased toward a closed position having the second side immediately adjacent the body garment, and permitting the pocket to be selectably folded between an open position where the second side faces away from the body garment and a closed position. Additionally, optionally the body garment may further comprise a wire to maintain the shape of the pocket.

In one embodiment, the body garment further comprises a flexible material having a third thickness, where the first thickness of the first side and the second thickness of the second side are each less than the third thickness.

In a preferred embodiment, the first side and the second side of the pocket each comprise a flexible material, which may each be individually selected from the group consisting of neoprene, nylon, latex, and PTFE.

A method for protecting a person's body from injury associated with repetitive contact with a hard surfboard surface is also disclosed, comprising the steps of identifying one or more than one vulnerable region of a person's body considered susceptible to injury associated with repetitive contact with a hard surfboard surface, constructing a body garment having an inside surface and an outer surface; and connecting one or more than one cushioning pad to the body garment, disposed adjacent the inside surface, or the outer surface, or the inside surface and the outer surface, and positioned in juxtaposition to the one or more than one vulnerable region of the body.

DETAILED DESCRIPTION

Figure 1:
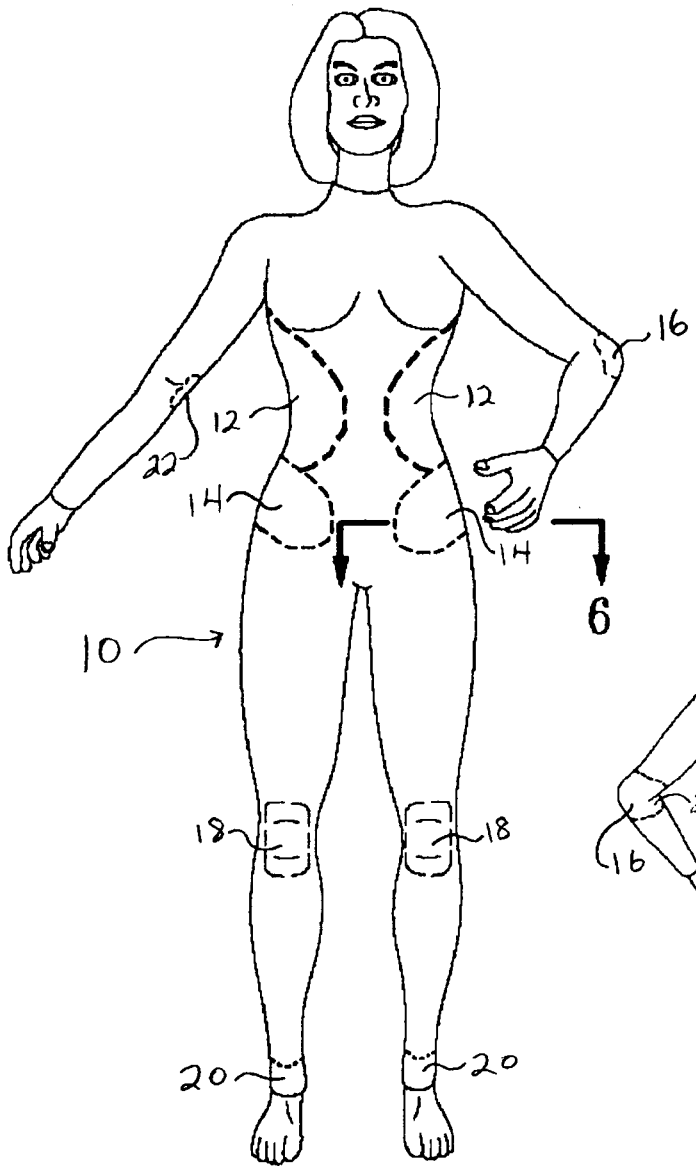
FIG. 1 is a front view of a wetsuit garment showing padded regions according to a preferred embodiment of the invention.

With reference first to FIG. 1, a wetsuit garment 10 that can be worn while surfing to protect vulnerable regions of a person's body from injury associated with repetitive contact with a hard surfboard surface is illustrated having various regions outlined. The wetsuit garment 10 is a body garment, typically comprising a flexible material, that is constructed to cover some, or most, of a person's body, while engaging in watersports.

Each of the outlined regions indicates padded portions of the wetsuit garment 10 comprising cushioning pads 12, 14, 16, 18, and 20 constructed according to one or more embodiments of the invention. The placement of cushioning pads 12, 14, 16, 18, and 20 has been designed to protect vulnerable regions of a surfer's body that have been identified as being particularly susceptible to bruising chafing, development of calluses and even permanent scarring as a result of repetitive contact and traumatic impact with a hard surfboard during surfing activities such as paddling, surfing maneuvers and even wipeouts. There areas include the ribs, hips, elbows, inner elbows, knees, ankles, and lower back. It is to be understood that other portions of a surfer's body may also be vulnerable to such injuries; thus, the positioning of padded portions should not be limited to the embodiments described below.

The illustrated cushioning pads 12, 14, 16, 18, and 20 are preferably disposed adjacent the inside surface of the wetsuit garment 10 and are tailored to provide padding in certain selected areas. For example, rib pads 12 are disposed in the area of lower ribs, hip pads 14 are positioned in the front around the upper hips, elbow pads 16 are positioned on the elbows, knee pads 18 are positioned on the knees, and ankle pads 20 are positioned around the ankles.

As discussed above, the surfer's ribs typically support a significant portion of the surfer's torso weight when the surfer is paddling. This is especially noticeable when the surfer paddles with an arched back. Accordingly, the lower ribs of many surfers will become sore, bruised or chafed from repetitive contact with the waxed, hard surfboard surface during paddling. The rib pads 12 are positioned on the wetsuit in a manner to generally surround the lower ribs and provide cushioning to alleviate the soreness and possible bruising that tends to occur in the rib area.

The front of the hips has been identified as one of the more significant and problematic pressure points for women surfers when they paddle on the surfboard. Because of the natural positioning of women's hips, much of a woman surfer's weight is supported by the hip directly adjacent the hip bone. As a result, bruising and chafing from the hard waxed surface of the surfboard has a pronounced and severe effect on the front of women's hips. Not only is this bruising and chafing painful, but it is also unsightly when a woman is wearing a women's swimsuit. Hip pads 14 are provided in the front portion of the wetsuit in order to protect a surfer's hips, especially a woman surfer's hips, during paddling and other surfing activities. Although women's hips have been identified as particularly prone to bruising and chafing, men's hips (not shown) and children's hips (not shown) also benefit from the hip pads 14. A further embodiment of garment 10 comprising wetsuit pants (not shown) having hip pads 14 may be constructed.

Figure 2:
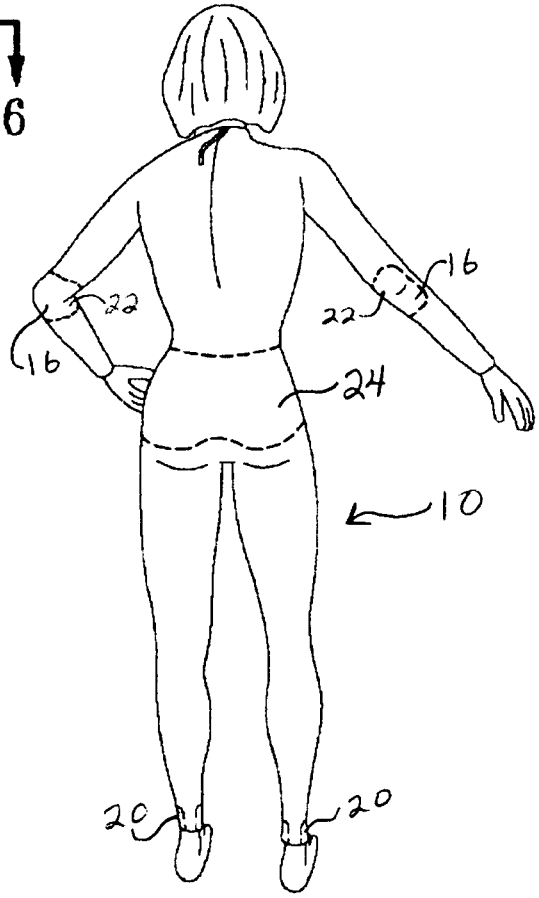
FIG. 2 is a back view of the wetsuit garment of FIG. 1, showing another embodiment of a padded region.

Bruising, chafing and such have also been found to occur on some surfer's elbows. Accordingly, elbow pads 16 are provided. For some surfers, the elbow contacts the board as the arm moves adjacent the surfboard during paddling. Repetitive contact of the inner side of some surfer's elbows with the surfboard during paddling can cause bruising, aching and chafing. Accordingly, as shown in FIG. 1 and FIG. 2, the elbow pads 16 may further comprise an inner elbow portion 22 extending at least partially along the wearer's inner elbow.

A surfer's knees tend to be a pressure point supporting weight and contacting the board while paddling and also during other surfing activities such as raising from a paddling position to a surfing stance. Accordingly, knee pads 18 are included in the embodiment shown in FIG. 1.

Some surfers use their ankles to contact the board and help maintain balance when paddling through turbulent waters. Additionally, some surfers may use front portions of their ankles to push the surfboard under water when attempting to dive under approaching crashing waves. Accordingly, ankle pads 20 are shown in the illustrated embodiment in FIG. 1. The ankle pads 20 preferably extend on the sides of the wetsuit legs and also may extend on the front of the wetsuit legs adjacent the feet.

Bruising and chafing can also occur along the surfer's lower back portion. Accordingly, FIG. 2 illustrates a back view of wetsuit garment 10 having back pad 24 along the lower back portion.

The cushioning pads may be inserted into the wetsuit in many different ways and may assume various positions around the wetsuit. Some methods of constructing the cushioning pads, as well as positioning of the cushioning pads, will be discussed below.

As shown in FIG. 1, the hip pads 14 preferably have a downwardly-angled curved shape and are positioned adjacent the inner surface of the wetsuit. The shape provides protection for the wearer's hips as the wearer is laying prone on the surfboard and continues to provide protection as the wearer partially rolls or otherwise contacts the surfboards proximate to the hips. Additionally, the curved shape softens the aesthetic effect of the padding within the wetsuit. As should be appreciated, it is undesirable to have a women's wetsuit which appears lumpy or may be otherwise aesthetically non-pleasing. The present shape maintains the generally smooth, attractive look of the wetsuit while providing protection in the area surrounding the hips. It is to be understood, however, that various shapes can satisfactorily be used to pad the hips.

Figure 5:
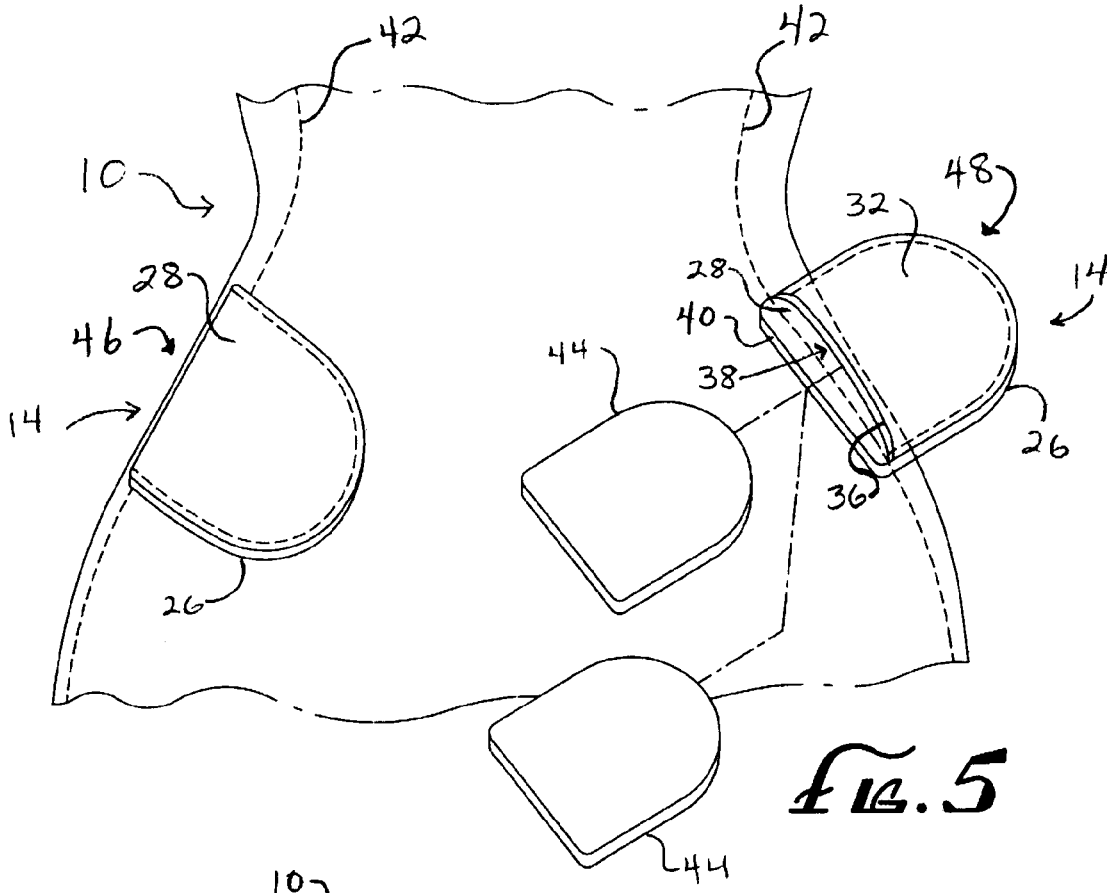
FIG. 5 is a perspective view of the hip area section of the wetsuit garment of FIG. 1 turned inside out, showing an embodiment of hip pads as pockets.
Figure 7:
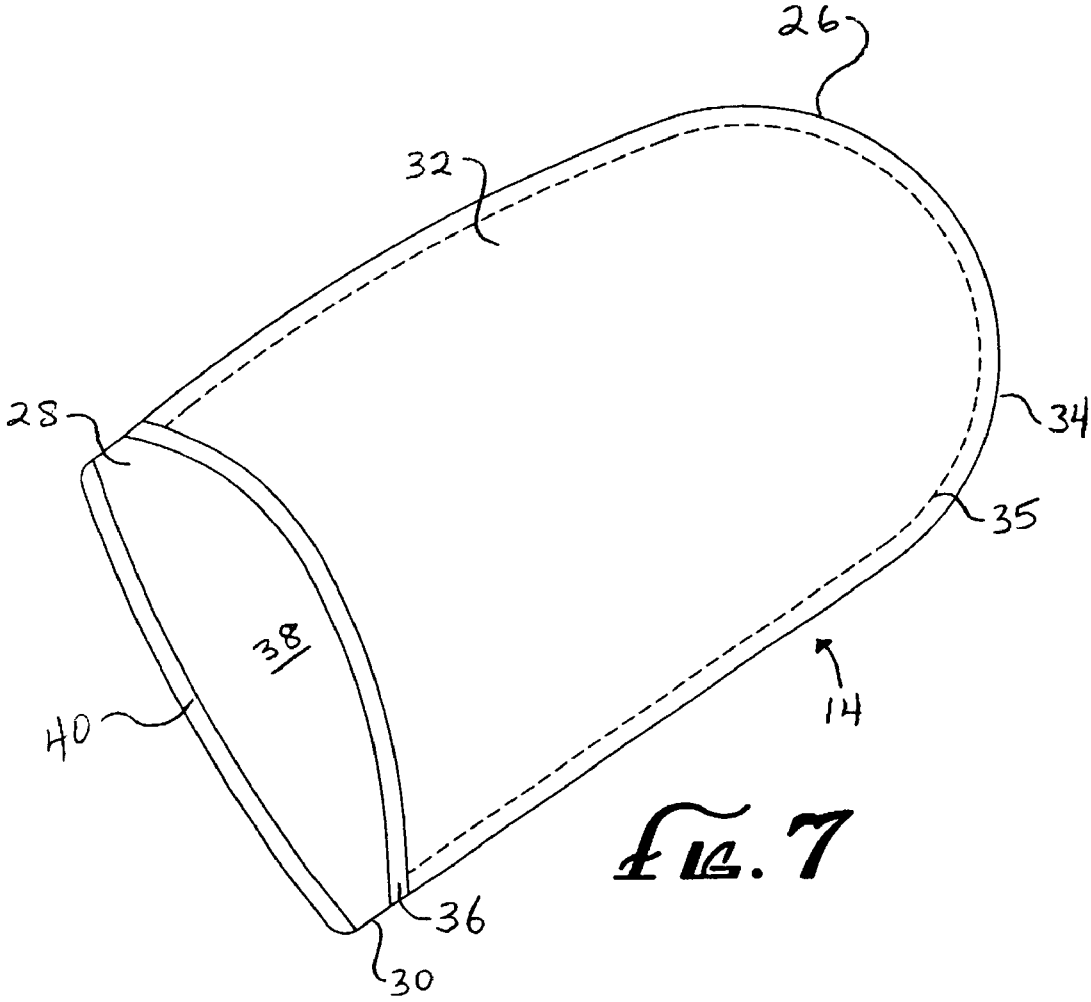
FIG. 7 is a perspective view of one of the pockets of FIG. 5.

With reference to FIG. 5, the wetsuit garment 10 is shown inside out in order to better show a preferred embodiment of the construction of hip pads 14. In this embodiment, each hip pad 14 preferably comprises a pocket 26 attached to the inside of the wetsuit garment 10. With reference to FIG. 7, each pocket 26 has a first side 28 having an edge 30 and a second side 32 having an edge 34 which overlap each other and are sewn or glued together along the seam 35. The first side 28 and second side 30, however, are not attached along a free edge 36 of the second side 32 so that an opening 38 between the first side 28 and second side 30 opens to a form the pocket 26. The leading edge 40 of the first side 28 extends somewhat beyond the free edge 36 of the second side 32.

With next reference to FIG. 5, the leading edge 40 of the first side 28 of the pocket 26 is preferably sewn and/or glued into a main side seam 42 of the wetsuit garment 10. The leading edge 40 is sewn such that the pocket 26 is biased toward a closed position 46 having the second side 32 immediately adjacent the wetsuit garment 10. The pocket 26 can, however, be folded back into an open position 48 so that the second side 32 faces away from the wetsuit garment 10 thereby making the pocket opening 38 accessible. As shown in FIG. 5, free edge 36 of the second side 32 is not attached to the main side seam 42.

An insert pad 44 can be inserted into the hip pad pocket 26. The insert pad 44 preferably has a shape generally complementary to the shape of the pocket 26 and can be inserted into the pocket 26 through the opening 38 when the pocket 26 is folded back to the open position 48. FIG. 5 shows successive stages of insert pad 44 being inserted into pocket 26. Once the pocket 26 is filled with the desired insert pad 44, the pocket 26 is moved into the closed position 46 where second side 32 is immediately adjacent to the wetsuit garment 10, as shown in FIG. 5.

When the wetsuit garment 10 is worn with the pocket 26 in the closed position 46, each hip pad 14 is positioned adjacent the hip, cushioning the hip. Preferably, the construction of the each hip pad 14 biases the pocket 26 toward the closed position 46. This bias facilitates holding the insert pad 44 securely therein.

Figure 6:
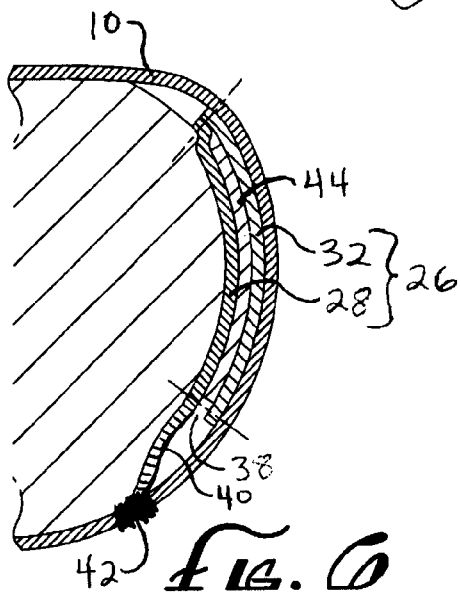
FIG. 6 is a cross-sectional view of one of the pockets of FIG. 5 in a direction as indicated in FIG. 1.

With next reference to FIG. 6, which is a cross-sectional diagram of the pocket 26 in a closed position 46, it can be seen that opening 38 of pocket 26 is blocked by the main side seam 42 and the leading edge 40 of the first side 28 of the pocket 26. The pocket 26 is wedged between the surfer's body and the wetsuit garment 10 so that the insert pad 44 will not work its way out of the pocket 26. Thus, the insert pad 44 remains in place even while the surfer performs various surfing maneuvers.

The first side 28 and second side 32 of the pocket 26 each preferably comprise a neoprene material much like that of the typical wetsuit, as will be evident to those skilled in the art. However, the neoprene material comprising the sides may be thinner than the material of the wetsuit, depending upon the wetsuit size. For example, the torso portion of a typical wetsuit is constructed of 2 to 3 millimeter thick neoprene. The first side 28 and second side 32 of the pocket 26 in the illustrated embodiment are about 1 millimeter neoprene. Of course, it is to be understood that the sides can be made of any thickness desired by the user and, in fact, can be made of various material such as, for example, nylon, which can be advantageous for its ability to be constructed thin and strong; latex, which can be advantageous for its ability to expand and stretch; and even thin layers of PTFE, which may be advantageous for their ability to keep the cushioning pads in a desired structural shape. The pockets may even include a wire to help them keep their shape.

The insert pad 44 of FIG. 5 comprises a portion of neoprene material that is significantly thicker than the first side 28 and second side 32 of pocket 26. An insert pad 44 about three-millimeter thick is used in the illustrated embodiment. However, it is to be understood that the insert pad 44 can be customized for each user and a range of insert pads of various thickness and flexibilities can be used. A padding system can be employed which includes insert pads of various sizes which can be used one at a time or in combinations within the pocket 26. For example, such a padding system may include a series of insert pads (not shown) including 1-millimeter insert pads, 2-millimeter insert pads, up through 5-millimeter insert pads, or more. Each of these insert pads may be used one at a time, or a number of insert pads can be used together to achieve desired padding parameters. In addition, insert pads having various stiffness properties can be combined for an advantageous padding structure customized for the needs of the surfer.

Although the illustrated insert pad 44 comprises a 3-millimeter portion of neoprene material, it is to be understood that any variety of materials can be used to make the insert pad 44, as will be evident to those skilled in the art with reference to this disclosure. For example, foams such as ethyl vinyl acetate (EVA) foam can advantageously be used. Additionally, sealed sacs containing material such as silicone gel or saline solution may be used. Further, various elastomeric foams or gels within sealed sacs can be acceptable. Still further, inflatable sacs adapted to be inflated by gel, water or air can be used and would provide a large measure of padding adjustability.

Considering the wide range of materials of various thickness and stiffness that can be used in conjunction with the pockets 26, the degree of padding desired by the user can be customized to the user's needs. Certain users will desire a thick layer of very soft padding while others may prefer to use a combination of soft padding and semi-hard padding in order to ease the transition from soft flesh and the hard fiberglass surfboard surface. Still others may find it acceptable not to use any insert pads 44 padding in the pocket 26 at all, but to use only the padding supplied by the first side 28 and second side 32.

The insert pads 44 can be secured in the pockets 26 in many ways. For example, in the illustrated embodiment, the insert pad 44 simply sits within the pocket 26 and is held in place when the pocket 26 is in the closed position 46. It is to be understood, however, that other means can be used to secure the insert pad 44 in position within the pocket 26, as will be evident to those skilled in the art with reference to this disclosure. For example, a hook and loop fastener (not shown) such as Velcro® may be mounted in the pocket 26 and on the insert pad 44. As the insert pad 44 is inserted into the pocket 26, the hook and loop fastener engages, thus holding the insert pad 44 securely in place.

Figure 8A:
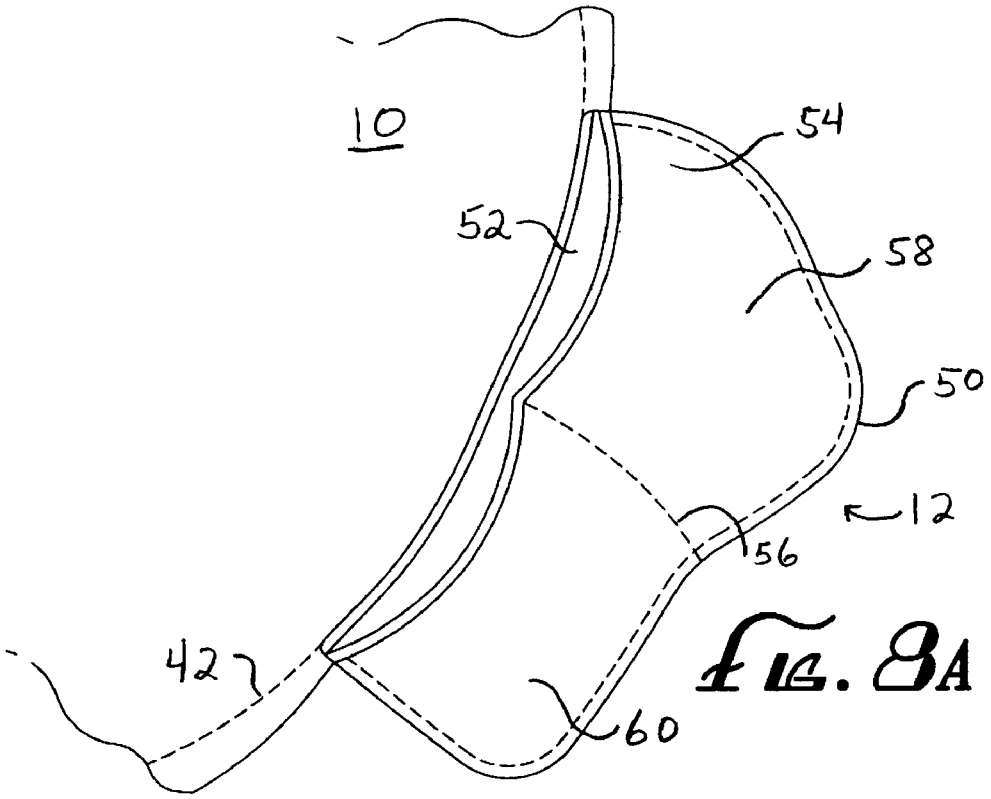
FIG. 8A is a perspective view of one rib area section of the wetsuit garment of FIG. 1 turned inside out, showing an embodiment of a rib pad.

The use of pockets in the construction of rib pads 12, elbow pads 16, knee pads 18, ankle pads 20 and back pad 24 is possible, as will now be evident to those skilled in the art with reference to this disclosure. With reference next to FIG. 8A, in a preferred embodiment, each rib pad 12 comprises a rib pocket 50 for providing padding for a wetsuit wearer's ribs. As with the hip pocket 26, each rib pad 12 preferably comprises a rib pocket 50 that is sewn onto the main side seam 42 of the wetsuit garment 10. It is to be understood, however, that the rib pocket 50 can be sewn onto any seam desired and, in fact a special seam just for the rib pocket 50 may be devised.

In a further embodiment, a single rib pocket (not shown) can be incorporated as a panel of the wetsuit garment 10, extending across the entire chest area.

Each rib pocket 50 preferably surrounds the lower ribs of the surfer, thus providing padding therefore. Since the area needed for rib padding is generally greater than the area of the hip padding, as will be evident to those skilled in the art with reference to this disclosure, individual surfers may desire more or less padding in certain areas of the ribs. For example, certain surfers may find that their lowermost ribs are particularly susceptible to aching and chafing, and thus may desire more padding towards the lowermost ribs than for the uppermost ribs. Accordingly, and as shown in FIG. 8A, the first side 52 and second side 54 of each rib pocket 50 may be joined at seam 56 thereby forming an upper rib pocket 58 and a lower rib pocket 60. This enables the wearer to selectively cushion certain areas of the ribs by, for example, placing a thicker insert pad 44 in the lower rib pocket 60 to provide extra padding for the lower ribs while placing a thin insert pad 44 or no insert pad at all in the upper rib pocket 58. This principle of dividing a single pocket into multiple pockets can also be applied to area of the wetsuit other than the ribs, as will be evident to those skilled in the art with reference to this disclosure.

Figure 8B:
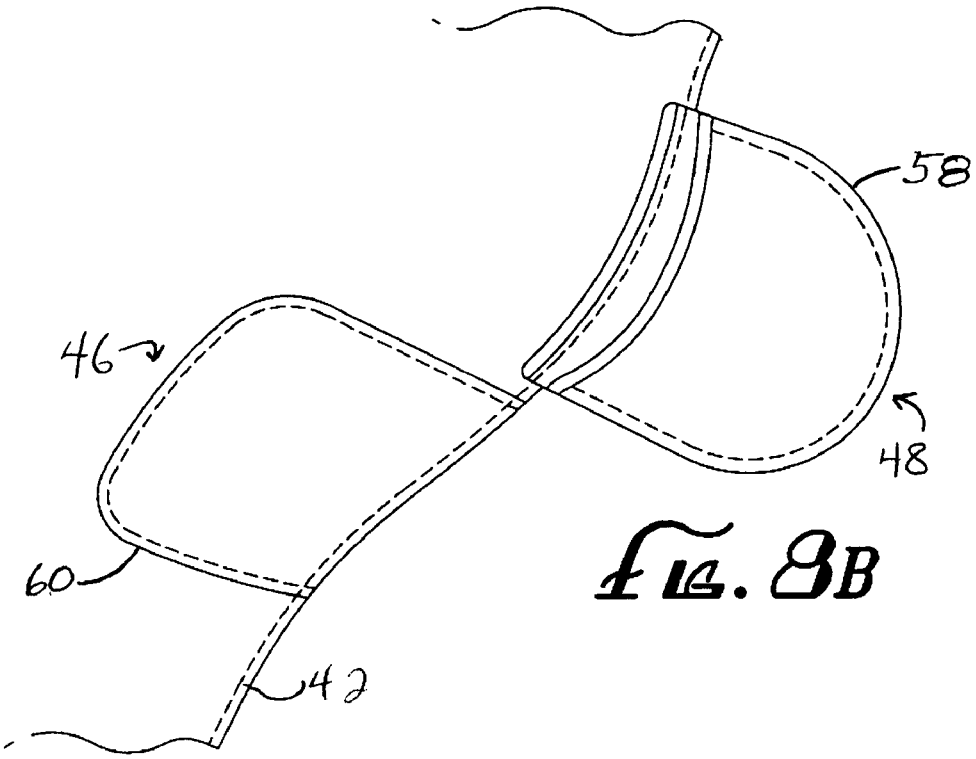
FIG. 8B is a perspective view of one rib area section of the wetsuit garment of FIG. 1 turned inside out, showing another embodiment of a rib pad.

With next reference to FIG. 8B, it is to be understood that multiple adjacent rib pockets can also be used in the rib area. FIG. 8B shows further embodiments of a lower rib pocket 60 and an upper rib pocket 58 that are formed adjacent to each other but entirely independent of each other. These pockets may be used to accommodate insert pads 44 having various sizes or may be selectively unused as determined by the wearer. For example, in FIG. 8B, the lower pocket 60 is in closed position 46 for use, but the upper pocket 58 is folded out of the way so it will not contact or cushion the wearer's upper ribs relative to the hard surfboard surface.

Figure 4:
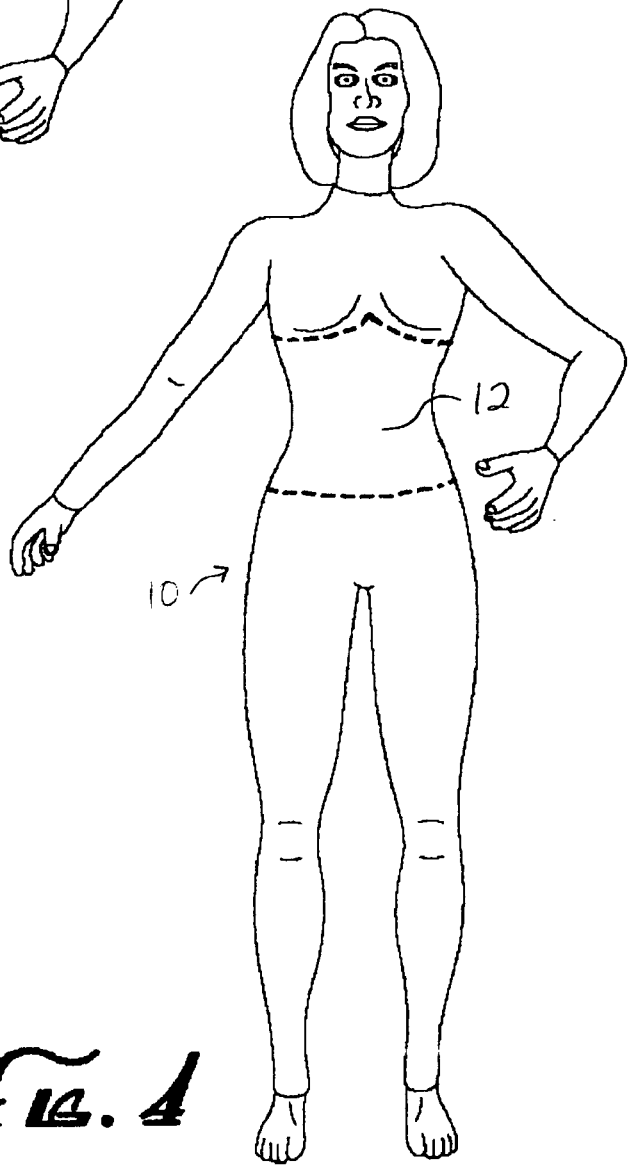
FIG. 4 is a front view of the wetsuit garment of FIG. 1, showing a further embodiment of padded regions.

With reference next to FIG. 4, it is to be understood that there are many ways of attaching cushioning pads onto a wetsuit garment 10. For example, the wetsuit garment 10 of FIG. 4 shows a rib pad 12 extending across the lower portion of the wetsuit top. In this embodiment, the cushioning pad is glued or sewn to the inside of the wetsuit and does not include a pocket. In a similar fashion (not show), the elbow pad 16, with or without inner elbow portion 22, could be sewn or glued into place. While the cushioning pads may be sewn into place along a wetsuit seam, it is to be understood that the cushioning pads can be sewn into place independent of seams in the wetsuit.

It is to be understood also that cushioning pads can be arranged in a way as to be removable, as will be evident to those skilled in the art with reference to this disclosure. For example, a hook and loop fastener (not shown) can be sewn into place in a position corresponding to the desired placement of the cushioning pad. The cushioning pad itself can be detachable and have a corresponding hook and loop fastener attached thereon. The removable cushioning pad can thus be put into place as desired by the user and can be adjusted to customize the fit. It is to be understood that cushioning pads having various shapes and sizes and being positioned at various locations in the wetsuit can have the corresponding hook and loop fastener sewn into place so as to be customizable by the user.

Figure 3:
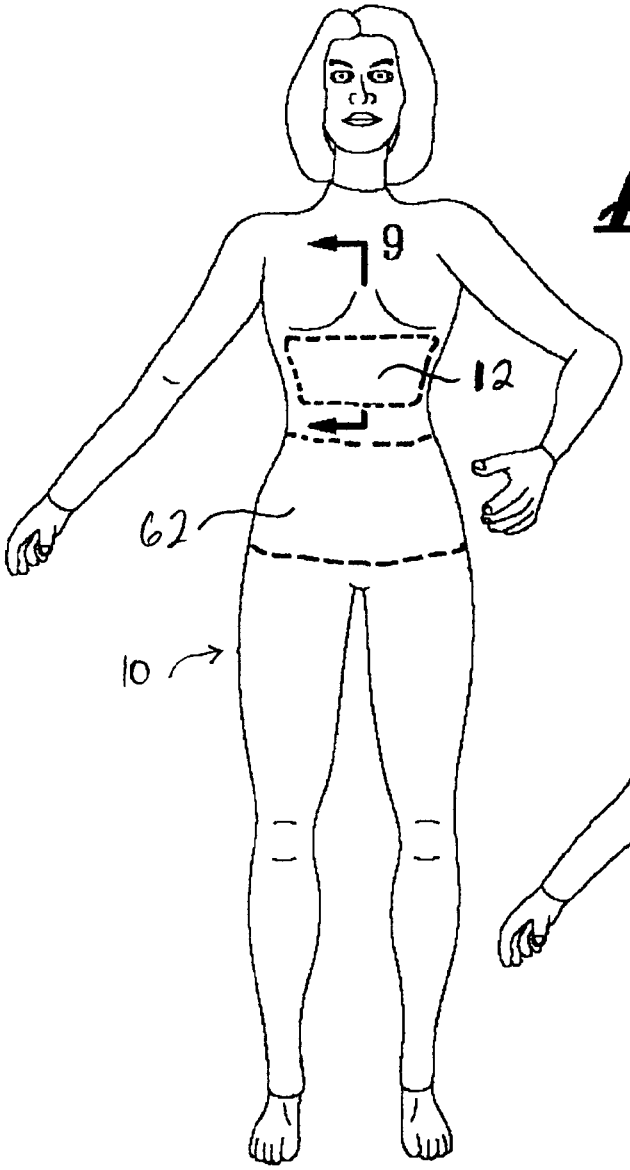
FIG. 3 is a front view of the wetsuit garment of FIG. 1, showing an embodiment of padded regions as a rib pad and a belt.

With next reference to FIG. 3, a belt 62 can provide padding in the hip area. This belt 62 comprises a layer of padding which is especially suited to encircle the upper hip areas of the wetsuit. The belt can be sewn into place on the inside or outside of the wetsuit or can be attached by a hook and loop fastener as discussed above. Additionally, the belt 62 can be worn independently of the wetsuit garment 10. In such an embodiment, the belt is independently wearable under or over any garment used for surfing.

Figure 9:
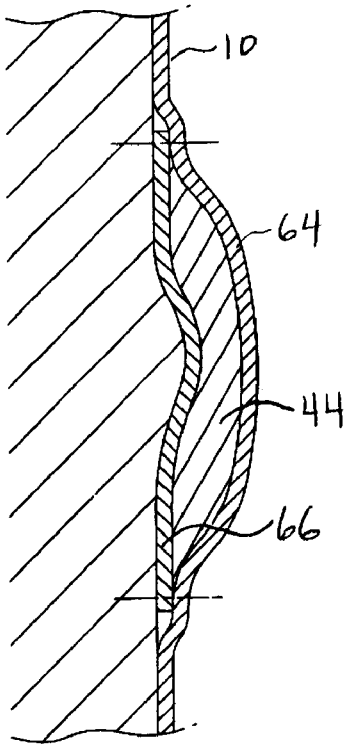
FIG. 9 is a cross-sectional view of the rib pad of FIG. 3.

With next reference to FIG. 3 and FIG. 9, another embodiment of wetsuit garment 10 comprises a single rib pad 12 comprising at least a two-ply wetsuit material wherein insert pad 44 or other padding material is sealed between the first layer 64 and second layer 66 of material. For example, a gel or foam material can be encased between the two wetsuit layers. The two-ply wetsuit portion can then be sewn or glued into place on the wetsuit in a conventional manner, thus providing construction of the various cushioning pads of the present invention.

In a related embodiment, the two-ply material can comprise a panel (not shown) of the wetsuit. In such an embodiment, a two-ply hip pad 14 can be sewn directly to adjacent neoprene wetsuit panels. The padding panel is placed to provide padding for a selected portion of the surfer's body. It is to be understood that any variety or combination of padding materials of various thickness, as discussed above, can also be incorporated into a wetsuit as a panel of the wetsuit.

Figure 10:
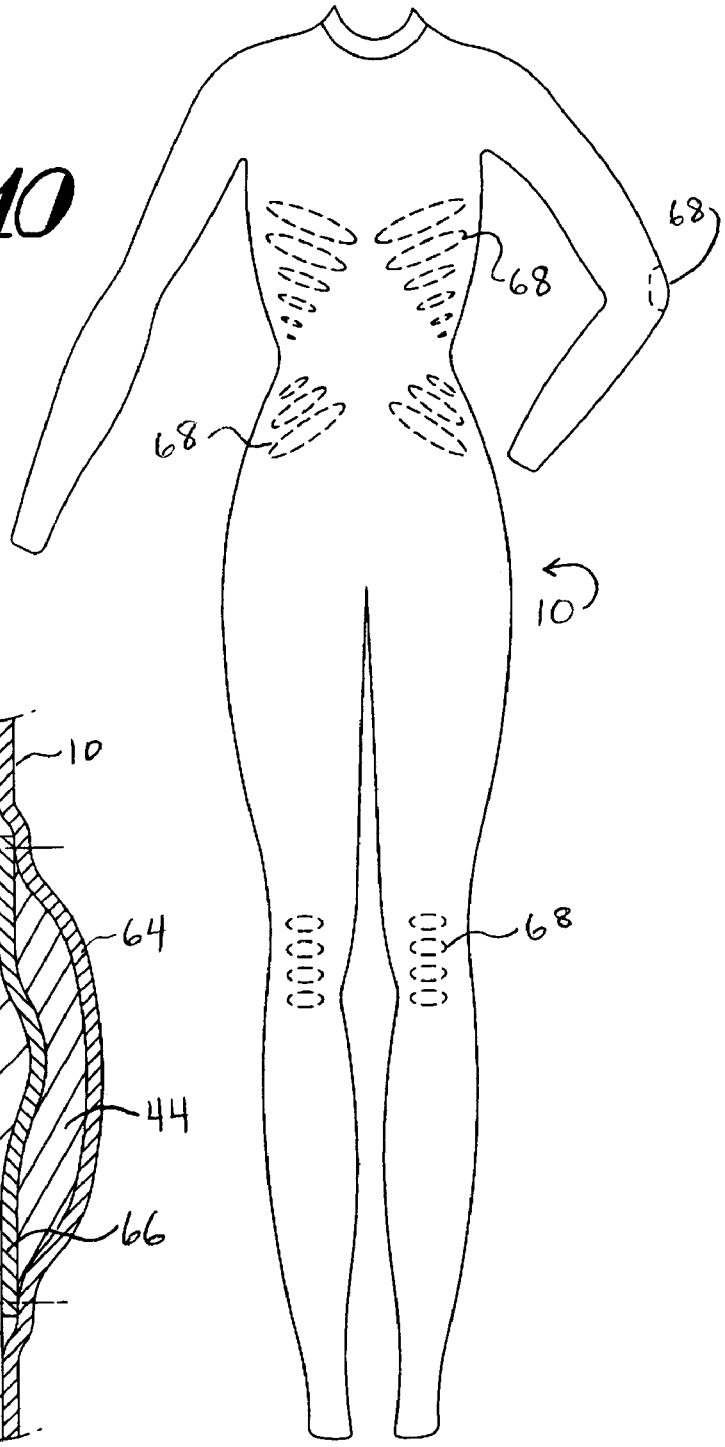
FIG. 10 is a front view of a wetsuit garment having padding disposed on the outside of the garment, according to another embodiment of the invention.

Padding can also be sewn or otherwise attached to the outside of the wetsuit. FIG. 10 shows another embodiment of a wetsuit garment 10 wherein cushioning pads are attached to the outside of the wetsuit in a plurality of exteriors areas 68. As shown in FIG. 10, preferably the exterior pads 68 are placed so that in combination they work alternatively as rib pads 12, hip pads 14, knee pads 18, etc.

Figure 11:
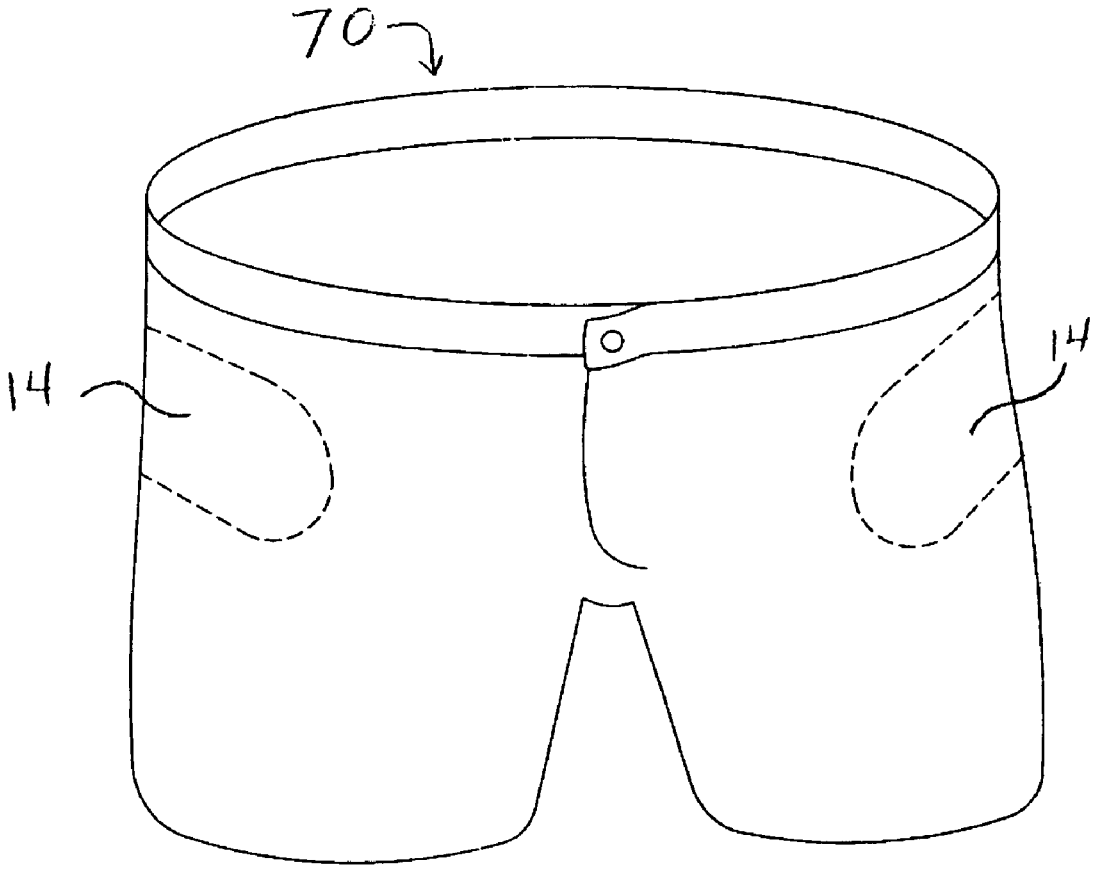
FIG. 11 is an elevation view of a pair of board shorts comprising hip pads, according to a further embodiment of the invention.

The embodiments described above have been described in connection with surfing wetsuits and wetsuit materials such as neoprene. It is to be understood, however, that various types of garments can be used for surfing and can be constructed in a manner so as to provide selective padding for the hips, ribs, ankles, etc. For example, when the water and/or air is relatively warm, surfers generally prefer to wear only a bathing suit and/or a pair of board shorts 70. As shown in FIG. 11, hip pads 14 according to the present invention can be provided within such a pair board shorts 70. Preferably, pockets 26 are used for the construction of hip pads 14. In the embodiment of FIG. 11, it is preferable that the first side 28 and second side 32 of each pocket 26 are constructed of a material similar to the cloth material used to construct the board shorts 70. In this manner, an insert pad 44 may be inserted into each pocket 26 to provide adequate protection while surfing but the insert pad 44 may be removed before and after surfing so that the board shorts retain an aesthetically pleasing appearance and comfort when worn out of the water.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above.

What is claimed is:

1. A garment for use in watersports to protect one or more than one vulnerable region of a person's body considered susceptible to injury associated with repetitive contact with a hard surface, comprising:

a body garment having an inside surface and an outer surface; and one or more than one cushioning pad connected to the body garment, disposed adjacent the inside surface, or the outer surface, or the inside surface and the outer surface, and positioned in juxtaposition to the one or more than one vulnerable region of the body, wherein the one or more than one cushioning pad connected to the body garment comprises:

one or more than one insert pad having a thickness, and one or more than one pocket for receiving the one or more than one insert pad, wherein the one or more than one pocket comprises a first side having a first thickness and an edge and a second side having a second thickness and an edge, the first side and second side overlapping each other and being attached together along their respective edges such that the first side and second side are not attached along a free edge of the second side, creating an opening between the first side and second side, a leading edge of the first side extending somewhat beyond the free edge of the second side, and the pocket being connected to the body garment along the leading edge.

2. The garment of claim 1 wherein the one or more than one vulnerable region is selected from the group consisting of the body area in proximity to the ribs, upper hips, elbows, inner elbows, knees, ankles, front of ankles adjacent the feet, and lower back.

3. The garment of claim 1 wherein the vulnerable region comprises the upper hips and the one or more than one cushioning pad comprises two hip pads each having a downwardly-angled curved shape.

4. The garment of claim 1 wherein the vulnerable region comprises the upper hips and the lower back and the one or more than one cushioning pad comprises a belt of padding which encircles the upper hip and lower back area.

5. The garment of claim 1 wherein the one or more than one cushioning pad is glued or sewn to the body garment.

6. The garment of claim 1, the body garment further comprising one or more than one seam, wherein the one or more than one cushioning pad is sewn to the body garment along a seam.

7. The garment of claim 1, the body garment having a second layer interior of the inside surface, where the one or more than one cushioning pad is sealed between the inside surface of the body garment and the second layer.

8. The garment of claim 1 wherein the insert pad has a shape generally complementary to the shape of the pocket.

9. The garment of claim 1 wherein the thickness of the one or more than one insert pad is about 3 millimeters.

10. The garment of claim 1, the one or more than one insert pad having a stiffness, further comprising a system of insert pads of varying thickness and stiffness.

11. The garment of claim 1, wherein the one or more than one insert pad comprises a flexible material.

12. The garment of claim 11 wherein the flexible material is selected from the group consisting of ethyl vinyl acetate (EVA) foam, elastomeric foam and silicone.

13. The garment of claim 1, wherein the one or more than one insert pad comprises a sealed sac containing silicone gel, saline solution, water or air.

14. The garment of claim 1, further comprising a hook and loop fastener connected to the one or more than one insert pad and the one or more than one pocket to releasably engage the insert pad in the pocket.

15. The garment of claim 1, wherein the vulnerable region comprises the ribs, and the one or more than one pocket comprises two rib pockets.

16. The garment of claim 15, wherein each of the two rib pockets further comprises an upper rib pocket and a lower rib pocket.

17. The garment of claim 15, the body garment further comprising a main side seam, wherein each of the two rib pockets are sewn onto the main side seam of the body garment.

18. A garment for use in watersport to protect one or more than one vulnerable region of a person's body considered susceptible to injury associated with repetitive contact with a hard surface, comprising:

a body garment having an inside surface and an outer surface; and one or more than one cushioning pad connected to the body garment, disposed adjacent the inside surface, or the outer surface, or the inside surface and the outer surface, and positioned in juxtaposition to the one or more than one vulnerable region of the body, wherein the one or more than one cushioning pad connected to the body garment comprises one or more than one insert pad having a thickness, and one or more than one pocket for receiving the one or more than one insert pad, wherein the one or more than one pocket is divided.

19. The garment of claim 1, wherein the vulnerable region comprises the ribs, and the one or more than one pocket comprises a single rib pocket.

20. The garment of claim 1, wherein the leading edge is connected to the body garment such that the pocket is biased toward a closed position having the second side immediately adjacent the body garment, and permitting the pocket to be selectably folded between an open position where the second side faces away from the body garment and a closed position.

21. The garment of claim 1 further comprising a wire to maintain the shape of the pocket.

22. The garment of claim 1, the body garment further comprising a flexible material having a third thickness, wherein the first thickness of the first side and the second thickness of the second side are each less than the third thickness.

23. The garment of claim 1 wherein the first side and the second side of the pocket each comprise a flexible material.

24. The garment of claim 21, wherein the flexible material of the first side is selected from the group consisting of neoprene, nylon, latex and PTFE, and the flexible material of the second side is selected from the group consisting of neoprene, nylon, latex, and PTFE.

25. A method for protecting a person's body from bodily injury associated with repetitive contact with a hard surface, comprising the steps of:

identifying one or more than one vulnerable region of a person's body considered susceptible to injury associated with repetitive contact with a hard surface;

constructing a body garment having an inside surface and an outer surface; and connecting one or more than one cushioning pad to the body garment, disposed adjacent the inside surface, or the outer surface, or the inside surface and the outer surface, and positioned in justaposition to the one or more than one vulnerable region of the body, wherein the one or more than one cushioning pad connected to the body garment comprises one or more than one insert pad having a thickness, and one or more than one pocket for receiving the one or more than one insert pad, wherein the one or more than one pocket comprises a first side having a first thickness and an edge and a second side having a second thickness and an edge, the first side and second side overlapping each other and being attached together along their respective edges such that the first side and second side are not attached along a free edge of the second side, creating an opening between the first side and second side, a leading edge of the second side extending somewhat beyond the free edge of the second side, and the pocket being connected to the body garment along the leading edge.

26. The garment of claim 1 wherein the respective edges of the first and second side are attached together by being sewn.

27. The garment of claim 1 wherein the respective edges of the first side and second side are attached together by being glued.

* * * * *